US009004714B2

(12) United States Patent
Hartman

(10) Patent No.: US 9,004,714 B2
(45) Date of Patent: Apr. 14, 2015

(54) LIGHT FIXTURE AND ILLUMINATED HARDSCAPE

(71) Applicant: Michael S. Hartman, Sinking Spring, PA (US)

(72) Inventor: Michael S. Hartman, Sinking Spring, PA (US)

(73) Assignee: Michael S. Hartman, Sinking Spring, PA (US)

( * ) Notice: Subject to any disclaimer, the term of this patent is extended or adjusted under 35 U.S.C. 154(b) by 72 days.

(21) Appl. No.: 13/896,740

(22) Filed: May 17, 2013

(65) Prior Publication Data

US 2013/0308302 A1 Nov. 21, 2013

Related U.S. Application Data

(60) Provisional application No. 61/648,354, filed on May 17, 2012.

(51) Int. Cl.

| | |
|---|---|
| ***F21V 21/02*** | (2006.01) |
| ***F21V 33/00*** | (2006.01) |
| *F21W 111/02* | (2006.01) |
| *F21W 131/107* | (2006.01) |
| *F21W 131/109* | (2006.01) |

(52) U.S. Cl.
CPC ..... *F21V 21/02* (2013.01); *F21V 33/006* (2013.01); *F21W 2111/02* (2013.01); *F21W 2131/107* (2013.01); *F21W 2131/109* (2013.01)

(58) Field of Classification Search
CPC ..... F21W 2111/02; F21V 21/02
USPC ..... 362/147, 145, 152, 362, 368, 370
See application file for complete search history.

(56) References Cited

U.S. PATENT DOCUMENTS

| | | | | |
|---|---|---|---|---|
| 7,524,077 | B2 | 4/2009 | Hartman | |
| 8,066,398 | B2 | 11/2011 | Hartman | |
| 8,672,502 | B2 * | 3/2014 | Hartman | 362/145 |
| 2012/0236547 | A1 | 9/2012 | Hartman | |

* cited by examiner

*Primary Examiner* — Vip Patel
(74) *Attorney, Agent, or Firm* — Fox Rothschild LLP

(57) ABSTRACT

A lamp adapted for mounting on a wall structure having a front face. The lamp includes a plate positionable within an opening in the front face of the wall. The plate has a top side and an underside and a front edge and a back edge. The back edge extends in a substantially semi-circular shape. A flange attached to the front edge of said plate is oriented at an angle relative to the plane of the plate. A light fixture is positioned adjacent the underside of the plate within a perimeter defined by the plate and a surface of the flange. A method of creating an illuminated hardscape is also disclosed.

22 Claims, 5 Drawing Sheets

FIG.4
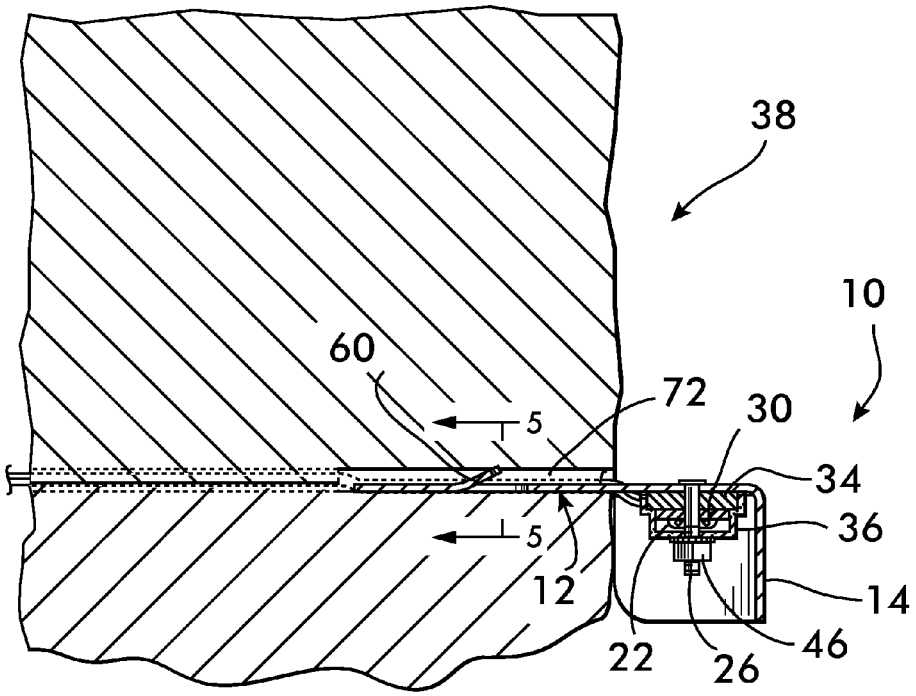
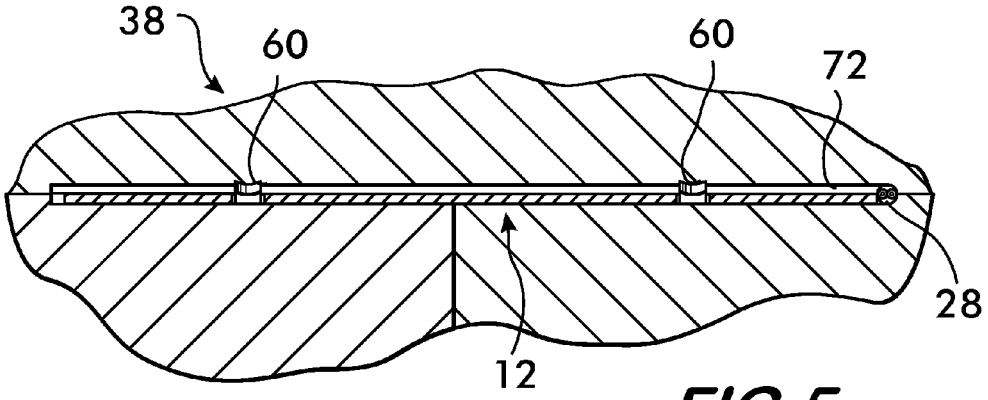
FIG.5

FIG.6
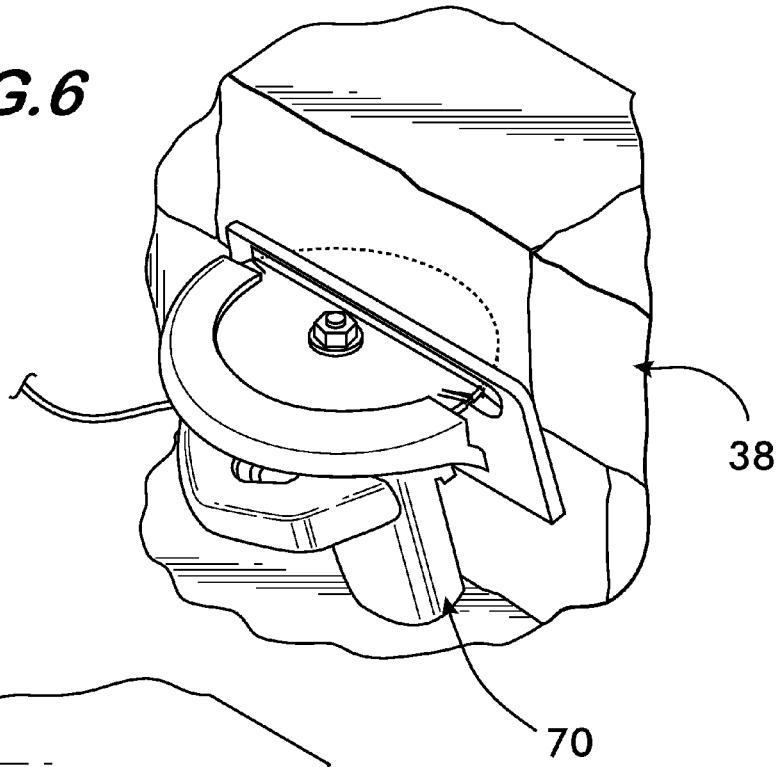
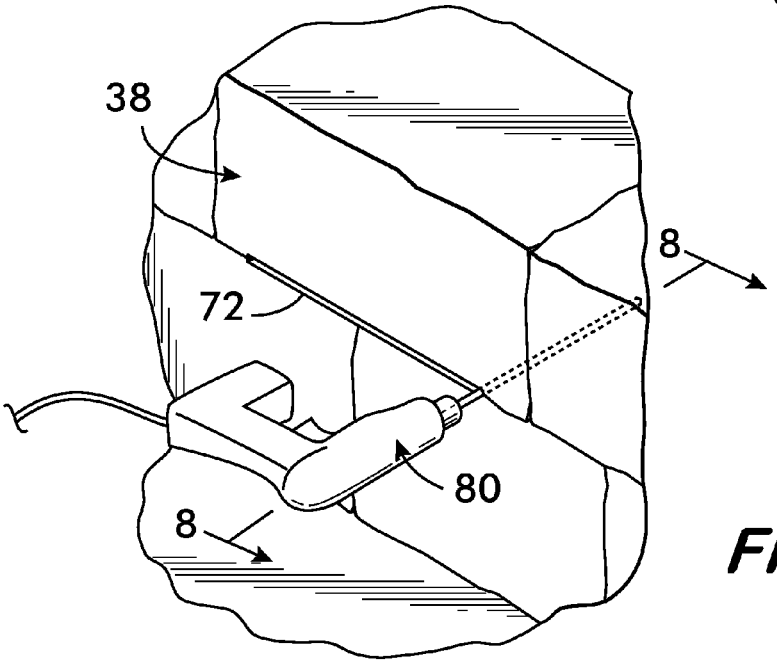
FIG.7

LIGHT FIXTURE AND ILLUMINATED HARDSCAPE

This application claims the benefit of U.S. Provisional Appln. No. 61/648,354 filed on May 17, 2012, which is incorporated herein by reference.

FIELD OF THE INVENTION

This invention relates to lighting for illuminating hardscape structures.

BACKGROUND OF THE INVENTION

Masonry structures used as a part of a landscape design are known as the "hardscape." The hardscape incorporates structures such as pathways, steps, driveways, retaining walls and the like into an aesthetic installation generally, although not exclusively, in an outdoor setting which combines plant, masonry, and lighting elements to enhance the visual environment of a residence, commercial facility or school campus to cite but a few examples.

The hardscape may be formed of natural stone, concrete, bricks or blocks manufactured from concrete which are available in various colors, shapes and textures that simulate natural or quarried stone. Such products, for example, those provided by companies such as EP Henry of Woodbury, N.J., include structural systems which allow for the construction of structures such as retaining walls using discrete masonry elements that may be positioned atop one another to form a wall without the use of mortar. The structure is, nevertheless, a substantially permanent structure due to the weight, regular shape, friction and quasi-interlocking nature of the discrete elements.

As lighting is often an important component of the landscape design, it is desirable to incorporate lighting elements, such as lamps, into the design. Present practice provides stand-alone lamps that mount in the ground adjacent to the hardscaping, and lamps that can be installed into the hardscaping during construction, but which are difficult to add after the hardscaping is completed. One such lamp is disclosed in U.S. Pat. No. 8,066,398 which is hereby incorporated herein by reference. It would be advantageous to provide lamps that can be added after the hardscaping is completed.

SUMMARY OF THE INVENTION

The present invention provides a lamp adapted for mounting on a hardscape structure, such as a structure formed of a plurality of discrete elements stacked one atop another, such as a stone or brick wall, or even a solid wall, such as a concrete or solid stone structure. The lamp includes a plate that is positionable within the structure. The plate may be placed in the structure prior to its construction, such as between at least two of the elements of the structure, with contact between the plate and the elements retaining the lamp in position in the structure. Alternatively, the plate may be placed in to an already existing solid structure through the use of a cut-out provided by suitable tool, such as a circular saw. The plate has a top side and an underside, and has a substantially straight front edge and a curved back edge to form the plate in a substantially semi-circular shape. The lamp further includes a flange attached to the front edge of the plate. The flange may be integrally connected to the plate and may be oriented substantially at a right angle to the plane of the plate. The flange may have a first surface facing away from the plate and a second surface positioned opposite the first surface. The lamp may further include a light fixture attached. The light fixture may be positioned facing the underside of the plate and the second surface of the flange. The light fixture may be attached to said second surface of said flange or to the underside of said plate.

The lamp may further include first and second side panels located at opposite ends of the flange. The side panels may be oriented angularly with respect to the flange. The flange may be in a substantially rectangular shape. The lamp may further include a second flange attached the underside of the plate, and is substantially parallel to the first flange. The light fixture may be attached to the underside of the plate at a location between the first and second flanges.

In another aspect, the present invention discloses an illuminated hardscape comprising a wall formed of a plurality of discrete elements positioned one atop another and a lamp, as described above, mounted on the wall.

In yet another aspect, the present invention discloses a method for creating an illuminated hardscape. The method includes the steps of: (1) providing a hardscape and (2) providing a lamp including a plate having a top side and an underside with a thickness defined by the distance between, wherein the plate has a substantially straight front edge and a curved back edge to form the plate in a substantially semi-circular shape, wherein the substantially semi-circular shape has a radius. The lamp further includes a flange attached to the front edge of the plate, the flange being oriented substantially at a right angle to the plane of said plate. The flange has a first surface facing away from said plate and a second surface positioned opposite said first surface. The lamp also includes light fixture. The light fixture may be positioned facing the underside of the plate and the second surface of said flange. The method further includes the steps of: (3) creating a generally semicircular cutout in the hardscape, the semi-circular cutout having a radius at least as large as the radius of the semi-circular shaped plate and a thickness greater than the thickness of the plate; and (4) sliding the plate into the cutout.

BRIEF DESCRIPTION OF THE DRAWINGS

The following detailed description will be better understood when read in conjunction with the figures appended hereto. For the purpose of illustrating the invention, there is shown in the drawings exemplary embodiments of the invention. It is understood, however, that the invention is not limited to the illustrated embodiments or the precise arrangements shown.

FIG. 4 is a cross-sectional view taken along line 4-4 in FIG. 1;

FIG. 5 is a cross-sectional view taken along line 5-5 in FIG. 4;

FIG. 6 is a perspective view of a step of assembly of an illuminated hardscape according to one embodiment of the present invention;

FIG. 7 is a perspective view of another step of assembly of the illuminated hardscape according to one embodiment of the present invention;

DETAILED DESCRIPTION OF THE EMBODIMENTS

Figure 1:
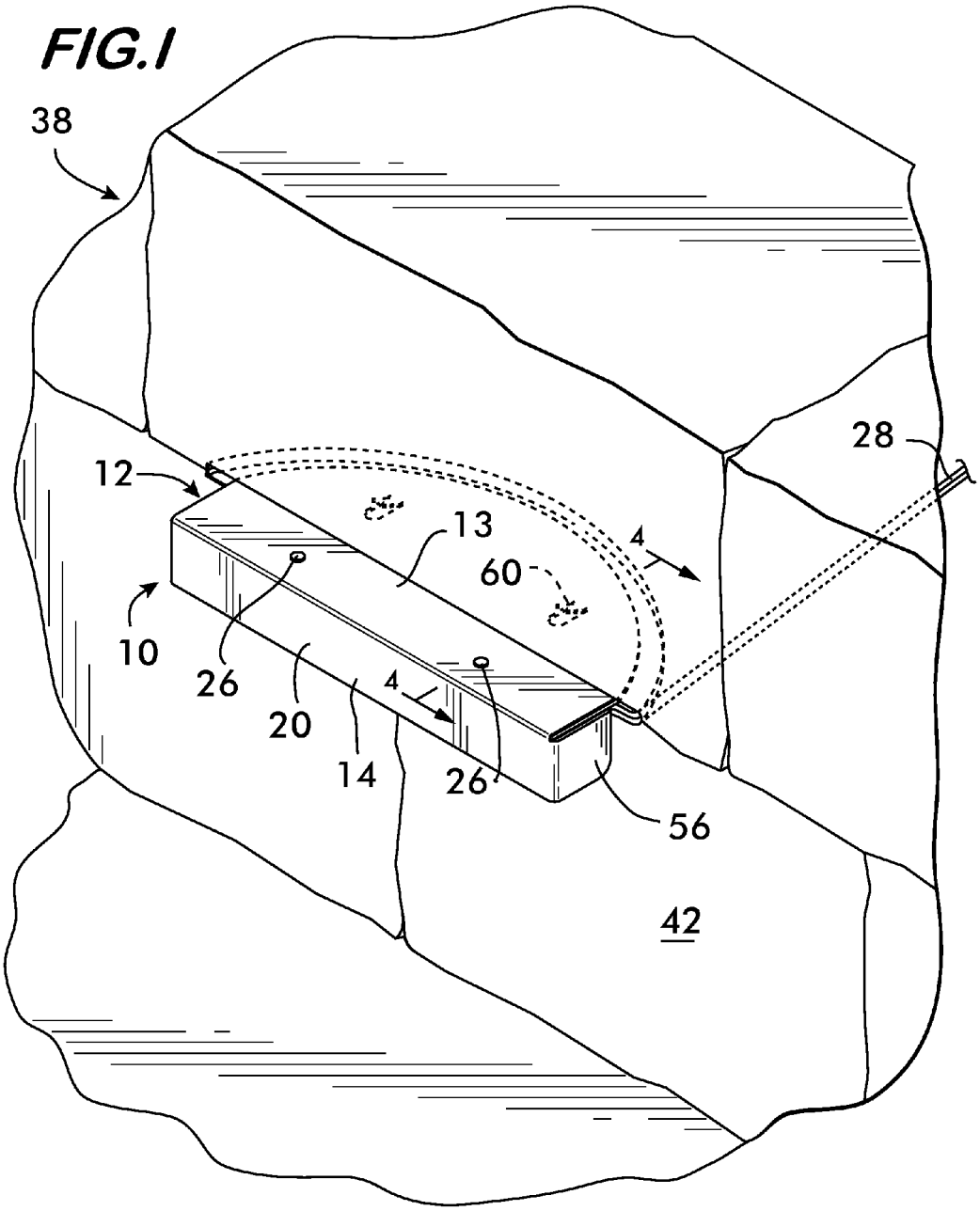
FIG. 1 is a perspective view of a portion of a hardscape structure including a lamp according to an exemplary embodiment of the invention.

FIGS. 1-5 show an exemplary lamp 10 integratable into a hardscape structure 38 for illumination. Lamp 10 comprises a plate 12 having a flange 14 attached thereto. Plate 12 has a top side 13 and an underside 15. As illustrated, the flange 14 may be integral with the plate 12 and oriented transversely to the plane of the plate 12. A right angle flange is shown, but it is understood that the flange 14 could be oriented at virtually any angle relative to the plate 12. The flange 14 may also be attachable to the plate 12 and be formed of multiple pieces or sections. The flange 14 has a front side 20 and a back side 24.

Studs 26 affixed to and extending from the plate 12 may be provided for attachment of a light fixture 18 adjacent the underside 15 of the plate 12. The light fixture 18 mounted to the plate 12 preferably includes a circuit board 30 having a light source 22 mounted thereon. In an exemplary embodiment, the light source 22 is formed of one or more LEDs, here two square arrays of 16 LEDs having parallel circuitry, 160 degree light distribution, warm white 3000K 5.0 watt Xenon equivalent output. Other light sources may also be utilized. An electrical wire 28 is soldered to leads on the circuit board 30 for power.

As shown in FIG. 4, the light fixture 18 is mounted to a heat sink 34 using a thermal epoxy to ensure good heat transfer. In the illustrated embodiment, the heat sink 34 is formed of a rectangular piece of metal, such as nickel plated copper, which is longer longitudinally than the circuit board. Any suitable material that provides good heat transfer can be used.

A translucent lens 36 covers the light fixture 18, covering the circuit board 30 and the light source 22, and the heat sink 34 to form a single unit that can be mounted on the plate 12. As shown in FIG. 4, the lens 36 is shaped to fit over and snap onto the heat sink 34, and includes openings for the studs 26 and an opening 40 for the electrical wire 28. The lens 36 can be made of any suitable translucent material such as a polymer, e.g., polycarbonate, acrylic, Plexiglass, etc.

The internal space between the lens 36, the circuit board 30 and the heat sink 34 may be filled with a translucent potting material (not shown) such as a two part silicone or epoxy potting material that preferably remains soft or gel like. This seals and protects the electrical components from the environment, and seals the openings for the studs 26 and the wire 28. The potting material may be added, for example, through an opening formed on the back side of the heat sink 34 and which is not covered by the circuit board 30. Some of the potting material may need to be removed for placement of the studs 26.

The light fixture 18, with the heat sink 34 and lens 36, is affixed as a unit to the plate 12 via the studs 26 and locking nuts 46. This forms the completed lamp assembly 10. The heat sink 34 preferably transfers heat to the plate 12 to aid in the removal of heat from the LEDs. The light fixture may have other structures, including other LED structures or structures utilizing other types of light sources. Such other light fixtures may not require a heat sink and/or a lens.

While the illustrated embodiment depicts the light fixture 18 as attached to the underside 15 of the plate 12, it is understood that the light fixture 18 may be attached to other locations on the lamp 10. More generally, and preferably, the light fixture 18, including at least one light source, can be attached anywhere to the lamp 10 relative to the plate 12 such that the light source is preferably on the underside of the plate 12 within a perimeter defined by the plate 12 and front side 20 of the flange 14. This keeps the light source shielded from a person eyes and directs the light downward. As a more specific alternative example, the light fixture 18 may be attached to the flange 14, such as on the back side 24.

The plate 12 has a front edge 50 that serves as the junction between the plate 12 and the flange 14. The front edge 50 has a first width W1. The plate 12 may also have side edges 52*a*, 52*b* that intersect the front edge 50 at a right angle to create a rectangular portion of the plate 12. The side edges 52*a*, 52*b* connect to a back edge 54 of the plate 12. The back edge 54 is configured such that a substantial portion of the back edge 54 has a width (W2 and W3, for example) measured parallel to the first width W1 which is less than the first width W1. In the illustrated embodiment, the back edge 54 is in the shape of a minor arc of a circle to match the configuration of a circular saw blade for purposes described below. In other embodiments, the back edge may take the form of a different shape.

As shown in the FIGS., the lamp 10 may also include side panels 56 that are positioned at opposite ends of the flange 14. The flange 14 and the side panels 56 cooperate to direct light from the light source 22 in the light fixture 18 downwardly along the hardscape on which the lamp 36 is mounted. The flange 14 may be integrally formed with the plate 12 and bent or molded into the angular orientation desired, or as a separate element, or elements, attached to the plate 12. The flange 14 may take any suitable configuration, including various shapes, thicknesses, sizes, color, and finish. Likewise, the side panels 56 may be an integral part of the flange 14 and bent or molded into an angular orientation, or be formed from separate pieces that are attachable to the flange 14.

Figure 2:
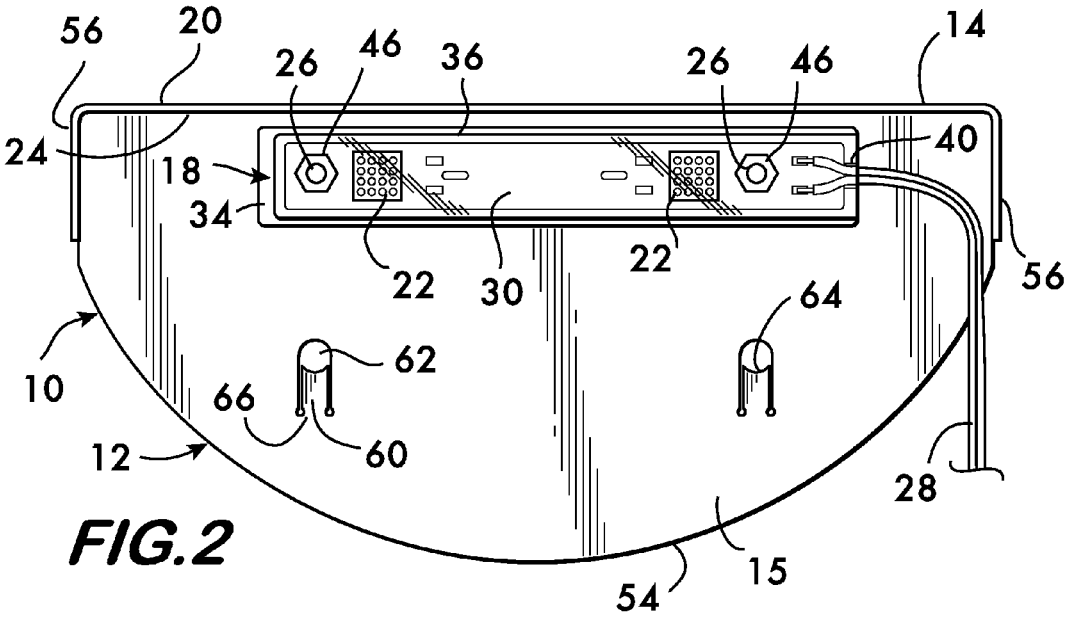
FIG. 2 is bottom view of the lamp shown in FIG. 1.
Figure 3:
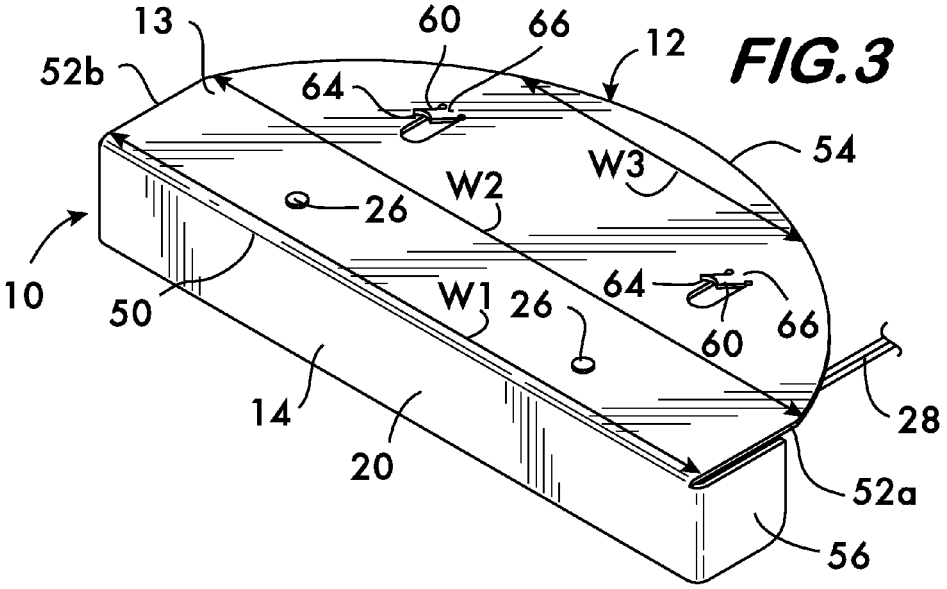
FIG. 3 is a perspective top view of the lamp shown in FIG. 1.
Figure 8:
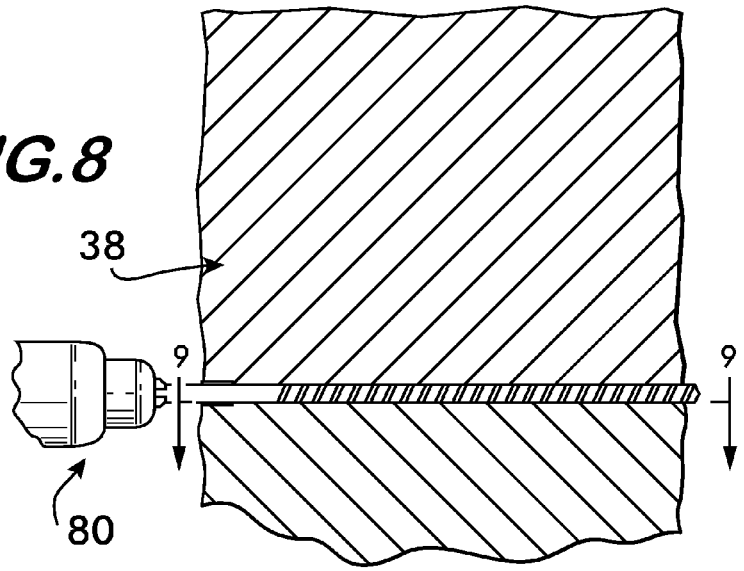
FIG. 8 is a cross-sectional view taken along line 8-8 in FIG. 7.
Figure 9:
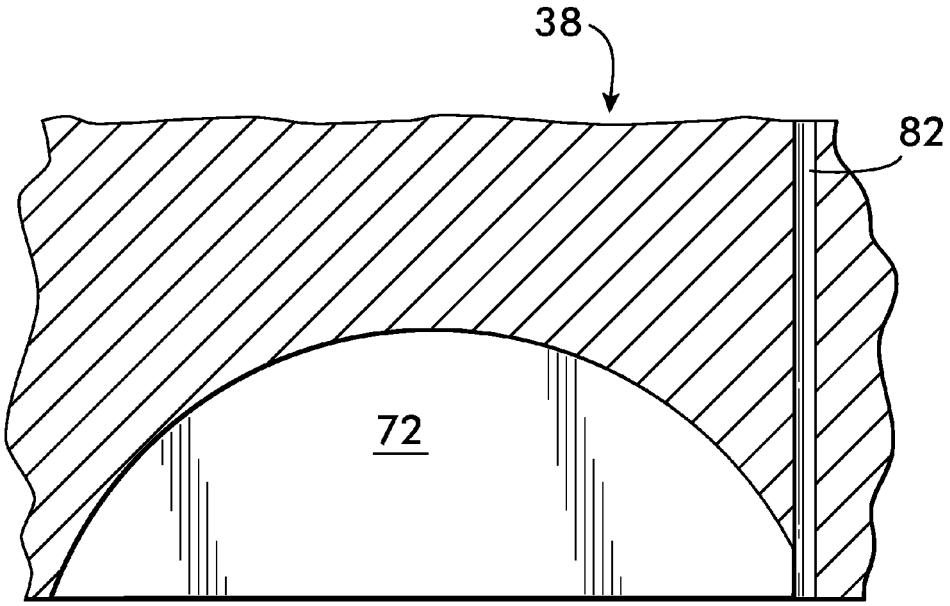
FIG. 9 is a cross-sectional view taken along line 9-9 in FIG. 8.

The plate 12 may also include cleats 60 and adjacent screw openings 62 to properly secure the lamp 10 in place. In an exemplary method of manufacture, the cleats 60 and openings 62 are cut by a laser. As shown in FIGS. 2 and 3, the cleats 12 may have a generally rectangular shape, and are attached to the plate at a single edge 66 so as to be bendable thereabout. The illustrated cleats 60 include two points along a front edge 64. The openings 62 are preferably located in front of each cleat 60 for receiving a tool for bending the cleats. As an alternative means of installation, the openings 62 can receive screws or other fastening means for holding the lamp 10 in place.

It is advantageous to make the plate, flange, faceplate and side panels from robust materials such as metal that can withstand the effects of weather. The plate and flange may be, for example, aluminum or stainless steel to prevent corrosion, and the faceplate and side panels may be copper or brass for a decorative effect. Plastics and fiber reinforced composites may also be used, as well as a combination of metals, plastics and other materials.

An exemplary method of installation of the lamp 10 is now described. This method is ideal for installing the lamp 10 after construction of the hardscape. As shown in FIG. 1, the lamp 10 is integrated into a hardscape structure, such as a retaining wall 38. The illustrated retaining wall 38 is formed from discrete block-like elements 42 positioned atop one another.

With reference to FIGS. 6-9, a method of installing the lamp 10 in the hardscape structure is illustrated. Preferably, a circular saw 70 is used to form a generally semicircular horizontal cutout 72 in the mortar joint of the hardscape, however, any known method in the art for creating such a cutout may be used. The blade of the circular saw 70 has a radius equivalent to, or slightly greater than that of the plate 12. In a preferable embodiment, the plate 12 has a radius of about 3.5 inches. Additionally, the cutout 72 formed by the circular saw 70 has a height that is the same or slightly greater than that of the thickness of the plate 12 to allow the plate 12 to slide therein. In a certain embodiment, the height of the cutout 72 is about an eighth (⅛) of an inch. Preferably, once the cutout 72 is formed, a drill 80 may be used to form a channel 82 in the retaining wall 38. This channel is sized to receive the electrical wire 28 that is used to provide electricity to power the light source.

As shown in FIG. 4, the lamp 10 is installed in the hardscape by sliding the plate 12, back edge 54 first, into the cutout 72. Simultaneously, the electrical wire 28 is passed through the channel 82 to be connected to a power source. When using the cleats 60, the cleats 60 are preferably functionalized prior to inserting the plate 12 in to the cutout 72. To functionalize the cleats 60, a user inserts a tool, such as the end of a screw driver, into the opening 62 to bend the cleats 60 at their respective attachment edge 66 until the cleats 60 are no longer in planar alignment with the plate 12. The cleats 60 are preferably bent upwards to ensure that the lamp 10 rests flat against the bottom of the cutout 72. If the cleats 60 are bent downwards prior to installation, the lamp 10 may rest in the cut-out at angle, which is undesirable. The distance from the underside 15 of the plate 12 to the front edge 64 of the cleat 60 when the cleat 60 is functionalized should slightly exceed the height of the cutout 72. When the plate 12 is forced into the cutout 72, the cleats 60 are resiliently bent back towards the plate 12 by the upper surface of the cutout 72 due to the resilient nature of the cleats 60. As depicted in FIGS. 4 and 5, once the lamp 10 is in place, the front edges 64 of the cleats 60 abut the retaining wall 38 at the upper surface of the cutout 72. In this position, the cleats 60 resist removal of the plate 12 from the cutout 72. Upon connection of the wire 28 to a power source, the lamp 10 is now operable. If necessary or desirable, a filler material, such as mortar, can be added into the cutout above the lamp 10. It is appreciated that this method of using a circular saw to install the lamp 10 is also suitable for use with solid walls, such as those formed from concrete.

Alternatively, the lamp 10 may be installed during the construction of the hardscape. Here, the lamp 10 can be placed on top of a block 42 and held in place by fasteners in the openings 62, by the friction and weight of the blocks 42, and/or mortar.

Lamps according to the invention provide a simple and elegant illumination for hardscape design that is easy to install and maintain. Such lamps are readily removable and repositionable and facilitate repair or reconfiguration of the hardscape as required. They may be used with any form of hardscape, for example, concrete products such as blocks or bricks, natural stone, mortared or stacked structures, wooden structures such as decks and retaining walls made from railroad ties to cite but a few exemplary applications.

What is claimed is:

1. A lamp adapted for mounting on a wall structure having a front face, said lamp comprising:

a plate positionable within an opening in the front face of the wall, said plate having a top side and an underside, wherein said plate has a front edge having a first width and a back edge, the back edge configured such that a substantial portion of the back edge has a width measured parallel to the first width which is less than the first width;

a flange attached to said front edge of said plate, said flange oriented at an angle relative to the plane of said plate, said flange having a first surface facing away from said plate and a second surface positioned opposite said first surface; and a light fixture positioned adjacent said underside of said plate within a perimeter defined by the plate and said second surface of said flange.

2. The lamp of claim 1, wherein the back edge has a substantially semi-circular configuration.

3. The lamp of claim 1, wherein the flange is at a substantially right angle relative to the plane of said plate.

4. The lamp of claim 1, wherein said light fixture is attached to said second surface of said flange.

5. The lamp of claim 1, wherein said light fixture is attached to said underside of said plate.

6. The lamp of claim 1, further comprising first and second side panels located at opposite ends of said flange, said side panels being oriented angularly with respect to said flange.

7. The lamp of claim 1, wherein said flange is integrally connected to said plate.

8. The lamp of claim 1, wherein said flange comprises a rectangular shape.

9. The lamp of claim 1, wherein said plate further comprises at least one resilient cleat.

10. The lamp of claim 9, wherein the at least one cleat extends from an attached edge to a free end with said free end extending toward said front edge.

11. The lamp of claim 10, wherein said free end includes one or more points extending toward said front edge.

12. The lamp of claim 1, wherein said plate includes opposed side edges extending between said front edge and said back edge, said side edges extending substantially perpendicular to the front edge.

13. The lamp of claim 1, wherein said opening in said front face is formed by cutting a slotted opening into said front face.

14. The lamp of claim 1, wherein said opening in said front face is formed by positioning a portion of said plate onto a surface of a discrete hardscape element and stacking one or more additional hardscape elements on said plate.

15. The lamp of claim 1, wherein said light fixture includes a circuit board with one or more LED elements attached thereto.

16. The lamp of claim 14, wherein a heat sink is positioned adjacent to said circuit board.

17. The lamp of claim 1, wherein said light fixture includes a light source and a lens is secured about the light source.

18. The lamp of claim 16, wherein a potting material is positioned within the lens.

19. A method for creating an illuminated hardscape, said method comprising:

creating a generally semicircular cutout in the hardscape, said semi-circular cutout having a first radius and a first thickness; and positioning the back edge of the plate of a lamp according to claim 1 into the cutout until the light fixture is proximate the hardscape.

20. The method of claim 19 wherein the plate has a second thickness which is less than or equal to the first thickness and the back edge has a semi-circular configuration having a second radius which is less than or equal to the first radius.

21. The method of claim 19 wherein the step of creating a semicircular cutout utilizes a circular saw.

22. The method of claim 19 further comprising the steps of drilling a hole through the hardscape in communication with the cutout and passing a power cord extending from the light fixture through the hole.

* * * * *